US005476289A

United States Patent [19]

Hoyt et al.

[11] Patent Number: 5,476,289

[45] Date of Patent: Dec. 19, 1995

[54] TEE HOLDING TAG

[75] Inventors: David Hoyt, Gardena; Gary Aldcroft, Long Beach, both of Calif.

[73] Assignee: Principle Plastics, Inc., Gardena, Calif.

[21] Appl. No.: 289,637

[22] Filed: Aug. 12, 1994

[51] Int. Cl.[6] ..... A63B 57/00

[52] U.S. Cl. ..... 283/80; D21/208; 224/918; 273/32 D

[58] Field of Search ..... 283/80; 224/918, 224/252, 919; 273/32 B, 32 D, 33; D21/208, 234; 206/315.1, 315.5, 315.9, 443; 40/666

[56] References Cited

U.S. PATENT DOCUMENTS

| | | | |
|---|---|---|---|
| D. 315,008 | 2/1991 | Popovits | D21/234 |
| 1,649,245 | 11/1927 | McGraw | 206/315.1 X |
| 1,665,214 | 4/1928 | McGraw | 224/918 X |
| 2,112,339 | 3/1938 | Kasparek | 224/918 X |
| 3,797,658 | 3/1974 | Peacock | 206/315.1 X |
| 5,158,179 | 10/1992 | Gosselin | 206/315.1 |
| 5,242,050 | 9/1993 | Billings | 206/315.1 X |
| 5,269,410 | 12/1993 | Abregano | 224/918 X |

*Primary Examiner*—Frances Han

*Attorney, Agent, or Firm*—John J. Connors; Connors & Associates

[57] ABSTRACT

Disclosed is a tag 10 adapted to be attached to a bag and the like. It includes a case 12 having a front face adapted to display identification and a recessed back section 18, and a plurality of tee holding elements 16 mounted to the back section. The tee holding elements 16 are each adapted to hold an individual golf tee 22 so that each tee is generally parallel to an adjacent tee. A clip 42 is connected to the case 12 for attaching the tag 10 to a golf bag and the like.

2 Claims, 1 Drawing Sheet

TEE HOLDING TAG

BACKGROUND OF THE INVENTION

1. Field of the Invention:

This invention relates to a tag particularly adapted to be attached to golf bags and the like. This tag has identification on one side indicating who owns the bag and on the opposite side includes tee-holders for removably holding golf tees.

2. Background Discussion:

It is conventional to attach tags to bags, such as golf bags, which identify the owner of the bag. It would be convenient for golfers to also have a way of holding tees to this tag. It is the objective of this invention to provide such a tee-holding tag.

SUMMARY OF THE INVENTION

The device of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include convenience, simplicity of use, and low cost manufacture.

The first feature of this invention is of the tag of this invention is that it includes a support member such as a case having a front face adapted to display identification and a back with a recessed section. There are a plurality of tee holding elements in the recessed section adapted to hold golf tees. A clip connected to the case is used to attach the tag to the golf bag.

The second feature is the shape of the support member. Preferably, it has a generally rectangular configuration, with a width slightly greater than the length of a golf tee. The recessed section has a front end, a rear end, and pair of opposed lateral sides. The lateral sides are spaced apart a distance slightly greater than the length of an individual tee, so that the tees are disposed within the recessed section upon placement in the tee holding elements. When placed in one of the tee holding elements, each tee is generally parallel to an adjacent tee and is generally parallel to the front and rear ends.

The third feature is that the tee holding elements are aligned in a row. These tee holding elements each comprise a pair of upstanding fingers spaced apart a predetermined distance approximately equal to the diameter of a tee. Each finger of each pair of fingers preferably has a detent and the detents on each pair of fingers are positioned to face each other. This enables the tee to be wedged securely between and held by a pair of fingers. Preferably, the upstanding fingers are positioned close to each other, requiring that the tees be placed between the pairs of fingers in alternate positions so that a toe of one tee is next to the head of an adjacent tee.

BRIEF DESCRIPTION OF THE DRAWINGS

The preferred embodiment of this invention, illustrating all its features, will now be discussed in detail. This embodiment depicts the novel and non-obvious device of this invention shown in the accompanying drawing, which is for illustrative purposes only. This drawing includes the following figures (FIGS.), with like numerals indicating like parts.

DETAILED DESCRIPTION OF THE PREFERRED EMBODIMENT

Figure 1:
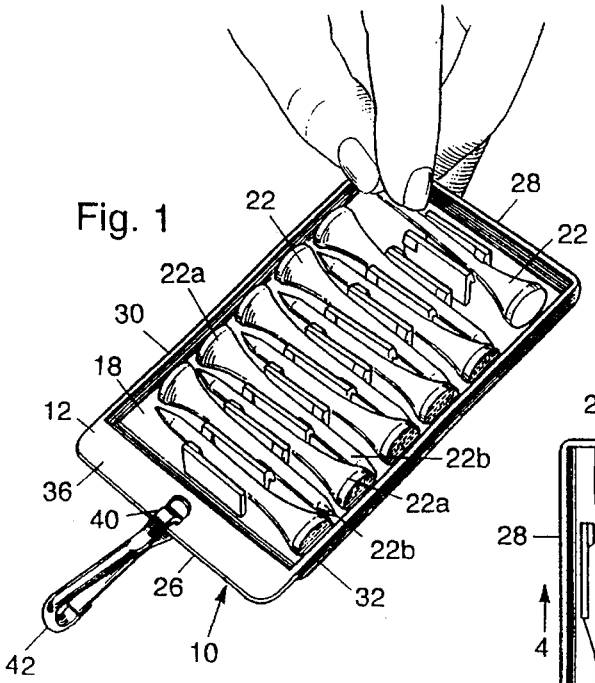
FIG. 1 is a perspective view of the tee holding tag of this invention.
Figure 2:
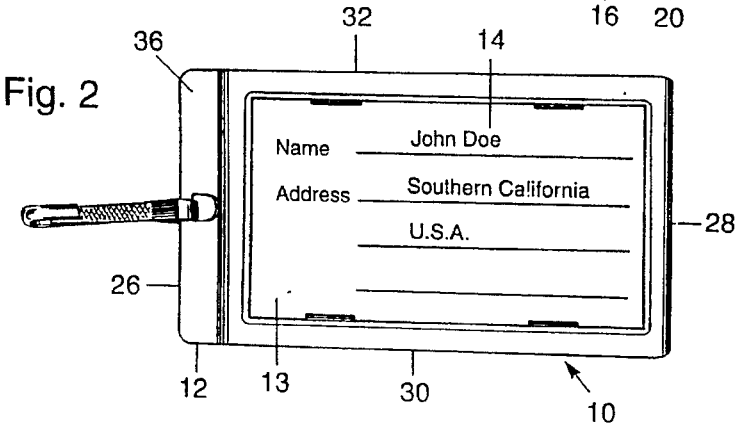
FIG. 2 is a plan view of the side of the tee-holding tags which displays the identification of the golfer.

The tee-holding tag 10 of this invention is best illustrated in FIGS. 1 and 2. It includes a case 12 having on one side an transparent plastic envelope 13 which holds a sheet of paper 14 identifying the owner of the bag to which the tag 10 is attached. On the opposite side are a row of aligned tee-holders 16 positioned side-by-side. These tee-holders 16 are disposed within a recessed section 18 within the case 12.

Figure 3:
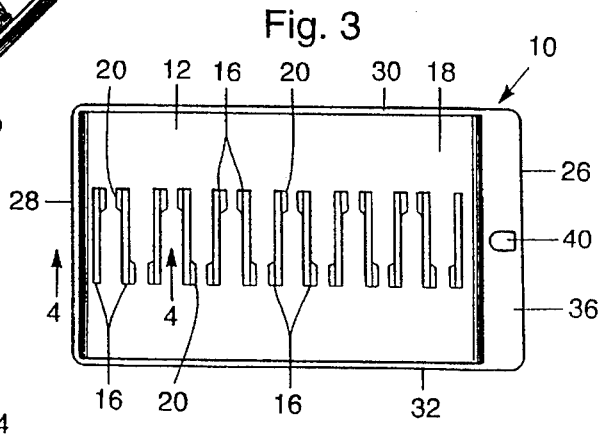
FIG. 3 is a plan view of the case of the tee-holding tag showing the tee-holding elements without tees being inserted into these elements.
Figure 4:
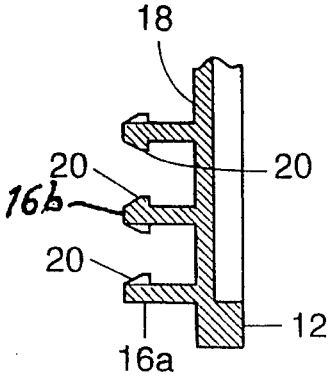
FIG. 4 is a cross sectional view taken along line 4—4 of FIG. 3.

As best illustrated in FIG. 4, each tee-holder 16 comprises a pair of upstanding finger elements **16*a* and 16*b*. Each finger element 16*a* and 16*b* has a detent 20 and, as best illustrated in FIG. 3, each finger element a detent 20 at its opposite ends. The purpose of this is so that the tees 22 are positioned closely spaced and staggered, with the head 22*a* of a tee 22 being disposed between toes 22*b*** of adjacent tees.

The case 12 has a generally rectangular configuration and is made of a molded plastic material. The front and rear ends 26 and 28, respectively, of the case 12 are generally at 90° relative to the lateral sides 30 and 32 of the case. The tees 22 are generally disposed parallel to the front and rear ends 26 and 28. There is an enlarged lip 36 at the front end 26 and a centrally located hole 40 in this lip. A conventional clip 42 is attached to the hole 40 which is used to attach the tag 10 to a golf bag (not shown).

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

We claim:

1. A tag adapted to be attached to a bag, comprising a case having a generally planar, substantially rectangular configuration with a front face adapted to display identification and an uncovered, open back having an exposed recessed section for holding tees that enables the user to have direct access to tees held in the recessed section, said recessed section having a front end, a rear end, and pair of opposed lateral sides, said lateral sides being spaced apart a distance slightly greater than the length of an individual tee so that said tees are disposed within the recessed section upon placement therein, a plurality of uncovered and essentially completely exposed tee holding elements in said recessed section side by side in a row, said tee holding elements each being adapted to hold an individual golf tee so that, when placed in one of said tee holding elements, each tee is generally parallel to an adjacent tee and is generally parallel to the front and rear ends, said tee holding elements each comprising a pair of uncovered, upstanding fingers spaced apart a predetermined distance approximately equal to the diameter of a tee, each finger having one end connected to the back and an exposed, opposed free end, said free ends enabling a user to place a tee directly between adjacent pairs of fingers between said free ends to wedge the tee between the pairs of fingers, each finger of each pair of fingers having a detent with the detents on each pair of fingers positioned to face each other, said fingers being positioned close to each other requiring that the tees be placed between said pairs of fingers in alternate positions so that a toe of one tee is next to the head of an adjacent tee, and a clip connected to the case for attaching the tag to the bag and the like.

2. The tag of claim 1 where adjacent tee holding elements share a common finger.

* * * * *